US006882254B2

(12) United States Patent
Okajima et al.

(10) Patent No.: US 6,882,254 B2
(45) Date of Patent: Apr. 19, 2005

(54) TRANSMISSION LINE WITH A DIELECTRIC PROTRUSION HAVING OPPOSING LONGITUDINAL SLOT AND TRANSMITTER-RECEIVER

(75) Inventors: Shingo Okajima, Ishikawa-ken (JP); Toshiro Hiratsuka, Machida (JP); Takeshi Okano, Yokohama (JP)

(73) Assignee: Murata Manufacturing Co., Ltd. (JP)

( * ) Notice: Subject to any disclaimer, the term of this patent is extended or adjusted under 35 U.S.C. 154(b) by 95 days.

(21) Appl. No.: 10/337,368

(22) Filed: Jan. 7, 2003

(65) Prior Publication Data

US 2003/0137366 A1 Jul. 24, 2003

(30) Foreign Application Priority Data

Jan. 9, 2002 (JP) ..... 2002-002590

(51) Int. Cl.[7] ..... H01P 3/16
(52) U.S. Cl. ..... 333/250; 333/248
(58) Field of Search ..... 333/239, 248, 333/250

(56) References Cited

U.S. PATENT DOCUMENTS 5,987,315 A * 11/1999 Nishida ..... 333/248 X
6,166,614 A * 12/2000 Ishikawa et al. ..... 333/239
6,614,332 B1 * 9/2003 Yamashita et al. ..... 333/239

FOREIGN PATENT DOCUMENTS

JP 06-053711 2/1994
JP 08-265007 11/1996
JP 10-075108 3/1998
JP 2000-196301 7/2000

OTHER PUBLICATIONS

Slot Line on a Dielectric Substrate, Seymour B. Cohn, IEEE Transactions on Microwave Theory and Techniques, vol. MTT–17, No. 10, Oct. 1969.

Jens Bornemann, "A Scattering–Type Transverse Resonance Formulation and its Application To Open, Conductor–Backed and Shielded Slotline (M)MIC Structures", IEEE MTT–S Digest, pp. , MTT–S International, Boston, MA, U.S.A., 695–698, (Jun. 1991).

Chan et al., IEEE Transactions on Microwave Theory and Techniques, vol. 37, No. 11, pp. 1716–1723 (1989).

* cited by examiner

*Primary Examiner*—Benny Lee
(74) *Attorney, Agent, or Firm*—Dickstein, Shapiro, Morin & Oshinsky, LLP

(57) ABSTRACT

A transmission line includes a dielectric substrate having first and second principal surfaces. A first conductive layer is provided on the first principal surface. A protrusion is provided on the second principal surface and a second conductive layer is formed so as to cover the outer surface of the protrusion. A slot is formed in the first principal surface such that the slot extends through the first conductive layer and faces the protrusion. Accordingly, a high-frequency signal does not radiate from the second principal surface and locally transmits with low loss between the bottom surface of the protrusion and the slot.

20 Claims, 14 Drawing Sheets

TRANSMISSION LINE WITH A DIELECTRIC PROTRUSION HAVING OPPOSING LONGITUDINAL SLOT AND TRANSMITTER-RECEIVER

BACKGROUND OF THE INVENTION

1. Field of the Invention

The present invention relates to a transmission line for transmitting a high-frequency signal of microwaves and millimeter waves, and to a transmitter-receiver such as a radar device or a communication device including the transmission line.

2. Description of the Related Art

As a transmission line for transmitting a high-frequency signal, a slot line, which is disclosed in S. B. Cohn: Slot Line on a Dielectric Substrate, IEEE MTT-17, PP. 768–778, October 1969, has been known. The slot line is formed by providing a conductive layer on a first principal surface of a dielectric substrate and by providing a rectangular slot in the conductive layer. In this slot line, a high-frequency signal forms a mode having an electric field which is parallel with the width direction of the slot and a magnetic field which is parallel with the longitudinal direction of the slot, and travels in the longitudinal direction of the slot.

Also, another transmission line is disclosed in Japanese Unexamined Patent Application Publication No. 8-265007. In this transmission line, a conductive layer is provided on each of the first and second principal surfaces of a dielectric substrate, each conductive layer is provided with a slot extending in a rectangular shape along the traveling direction of a high-frequency signal, such that the slots face each other.

In the transmission line (slot line) according to S. B. Cohn: Slot Line on a Dielectric Substrate, IEEE MTT-17, PP. 768–778, October 1969, a high-frequency signal easily radiates through the slot and a current flow concentrates near both ends of the slot. Accordingly, transmission loss disadvantageously increases.

On the other hand, in the transmission line according to Japanese Unexamined Patent Application Publication No. 8-265007, a high-frequency signal locally travels inside the dielectric substrate and the vicinity thereof, and thus transmission loss can be reduced compared to the above-described slot line. However, when the two slots formed in the first and second principal surfaces of the dielectric substrate are displaced with respect to each other, a high-frequency signal radiates from the first and second principal surfaces of the dielectric substrate, which results in an increase in transmission loss.

SUMMARY OF THE INVENTION

The present invention has been made in view of the above-described problems in the known art, and it is an object of the present invention to provide a transmission line in which transmission loss of a high-frequency signal can be reduced, and to provide a transmitter-receiver in which transmission loss of a high-frequency signal can be reduced.

In order to solve the above-described problems, the present invention provides a transmission line comprising: a dielectric substrate including first and second principal surfaces and a protrusion which is provided on the second principal surface and which continuously extends in the transmitting direction of a high-frequency signal, the cross-section of the dielectric substrate and the protrusion being a protruding shape; a first conductive layer provided on the first principal surface; a second conductive layer provided on the second principal surface; and a slot provided in the first conductive layer so as to extend along the direction of the protrusion.

With this configuration, a waveguide can be formed by the protrusion and the slot, and a high-frequency signal can be transmitted by using the waveguide. Also, since the protrusion is covered with the second conductive layer, the high-frequency signal does not radiate from the second principal surface of the dielectric substrate. Accordingly, the high-frequency signal radiates only through the first principal surface even if the protrusion and the slot are displaced with respect to each other, and thus transmission loss due to the radiation can be reduced.

In the present invention, the slot in the dielectric substrate is preferably placed at a position facing the protrusion. Further, the shape of the slot is substantially the same as that of the portion where the protrusion contacts the dielectric substrate. With this configuration, transmission loss can be minimized and the high-frequency signal can be transmitted more efficiently.

Preferably, the transmission line of the present invention further comprises a plurality of through-holes extending through the dielectric substrate in the thickness direction thereof so as to establish conduction between the first and second conductive layers, the through-holes being placed at both sides of the protrusion. With this arrangement, the high-frequency signal can be confined between the protrusion and the slot by the through-holes placed at both sides of the protrusion. Accordingly, the high-frequency signal does not radiate from both sides of the protrusion and transmission loss can be reduced.

The transmission line of the present invention may further comprise a shield member for covering the slot, the shield member being provided on the first principal surface. With this configuration, the high-frequency signal which radiates through the slot can be confined in the vicinity of the slot by using the shield member. Accordingly, transmission loss of the high-frequency signal can be reduced and unnecessary radiation of the high-frequency signal can be prevented.

The transmission line of the present invention may further comprise arc portions formed at corners of the protrusion, and the connecting portion between the protrusion and the dielectric substrate (i.e., foot of the protrusion) is formed to be arc-shaped. With this configuration, a gap or crack is prevented from being generated in the second conductive layer at the corners of the protrusion and the vicinity thereof so that the second conductive layer is continuous and covers the arc portions. Accordingly, a current can be applied to the second conductive layer, which covers the whole surface of the protrusion including the arc portions, and concentration of current can be alleviated and transmission loss can be reduced.

The dielectric substrate may comprise one of a ceramic material, a resin material, and a composite material containing a ceramic material and a resin material. These materials are useful to improve the heat resistance of the dielectric substrate. Therefore, various surface-mounting components can be mounted by using batch reflow soldering so as to increase productivity.

Also, the present invention provides a transmitter-receiver including the transmission line according to the present invention.

DESCRIPTION OF THE PREFERRED EMBODIMENTS

Hereinafter, a transmission line according to preferred embodiments will be described in detail with reference to the attached drawings.

First Embodiment

Figure 1:
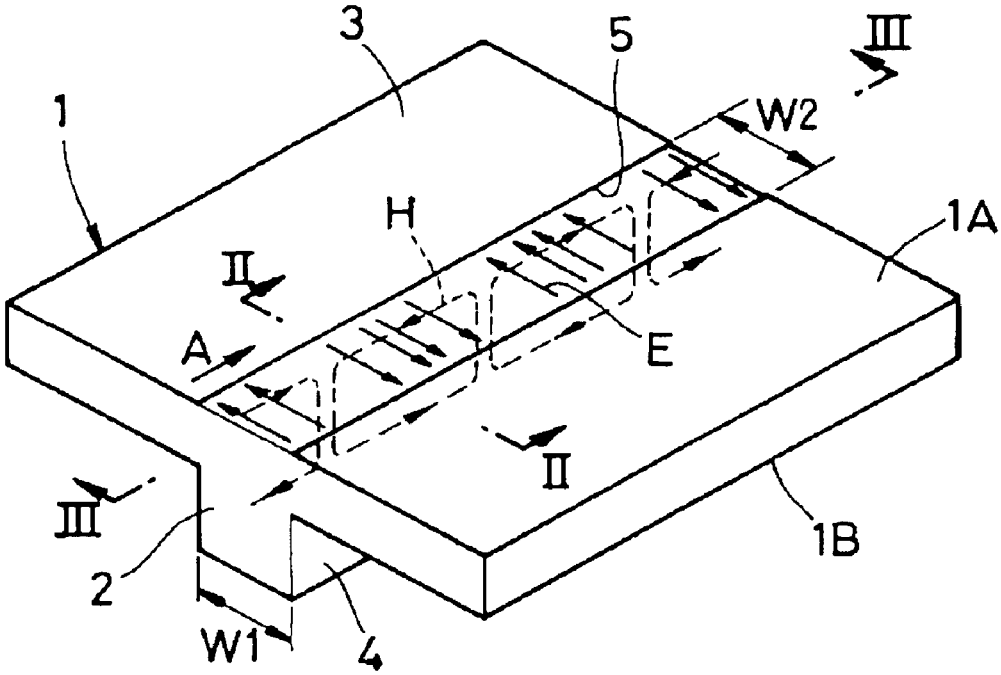
FIG. 1 is a perspective view showing a transmission line according to a first embodiment.
Figure 2:
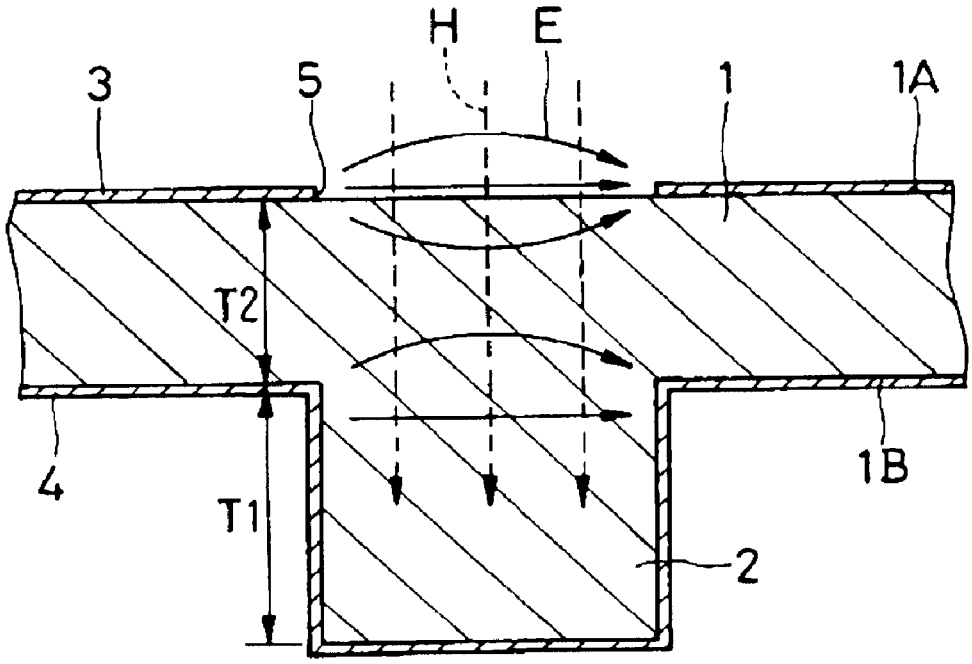
FIG. 2 is an enlarged sectional view taken along the line II—II of FIG. 1.
Figure 3:
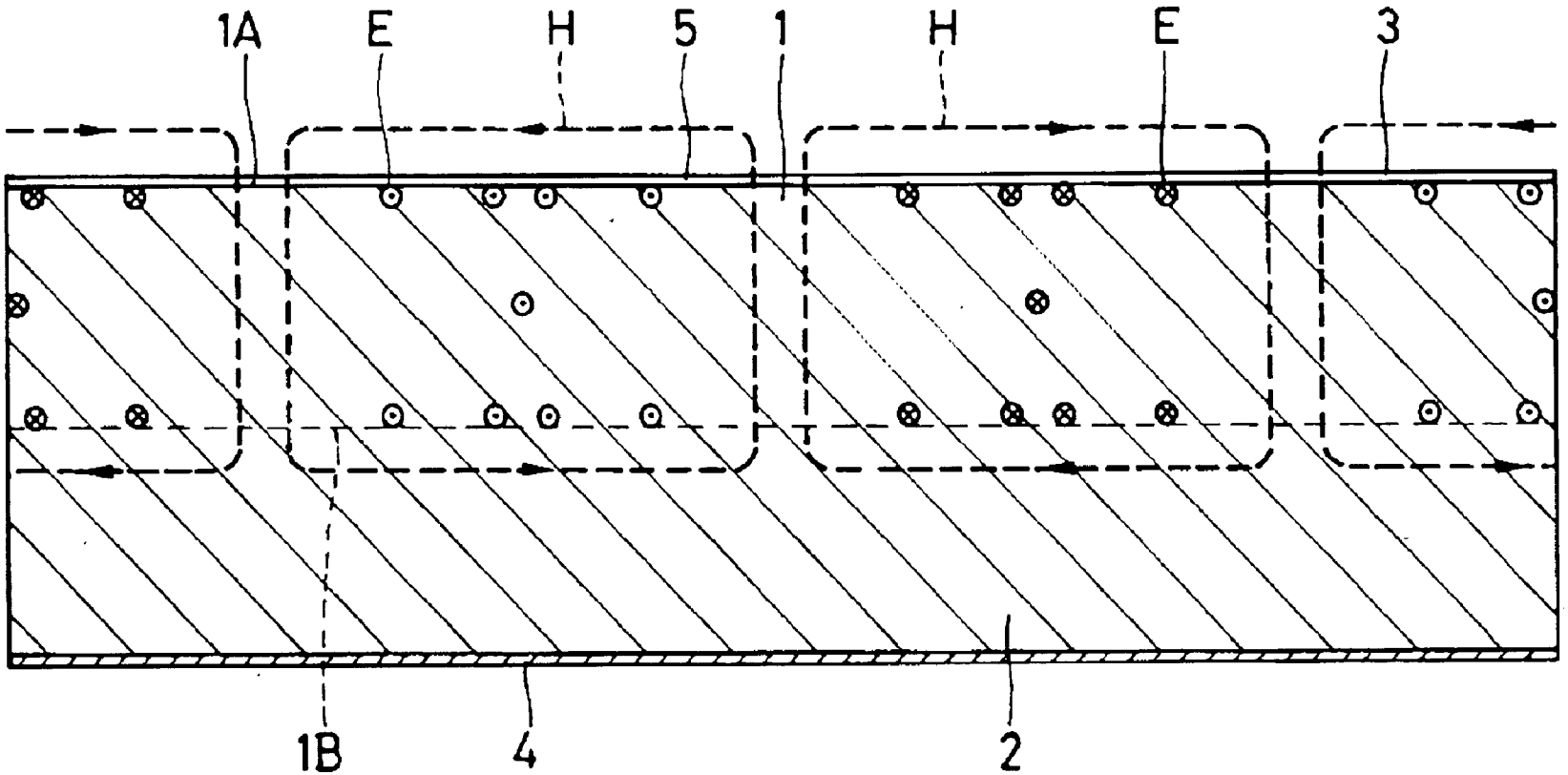
FIG. 3 is an enlarged sectional view taken along the line III—III of FIG. 1.

FIGS. 1 to 3 show a transmission line according to a first embodiment. In FIG. 1, a dielectric substrate 1 preferably comprises a resin material, a ceramic material, or a composite material prepared by mixing and sintering a resin material and a ceramic material. The dielectric substrate 1 preferably is a flat plate having a thickness T2 (FIG. 2) of about 0.3 mm and a relative permittivity $\in r$ of about 7.0, and has a first principal surface 1A and a second principal surface 1B which are preferably parallel with each other. The second principal surface 1B is provided with a protrusion 2 extending along the traveling direction (i.e., direction of an arrow A) of a high-frequency signal of microwaves and millimeter waves. Accordingly, the cross-section of the dielectric substrate 1 and the protrusion 2 forms a protruding shape.

The protrusion 2 preferably has a width W1 of about 0.45 mm in the horizontal direction (i.e., direction parallel to the first and second principal surfaces) and a height T1 (FIG. 2) of about 0.38 mm (i.e. height in the direction perpendicular to the first and second principal surfaces) so that the protrusion 2 protrudes from the second principal surface 1B of the dielectric substrate 1. The protrusion 2 is preferably made of the same material as that of the dielectric substrate 1 and is preferably integrally molded with the dielectric substrate 1. Alternatively, the protrusion 2 may comprise a different material from that of the dielectric substrate 1, and may be attached to the flat dielectric substrate 1.

A first conductive layer 3 is formed on the first principal surface 1A of the dielectric substrate 1 and a second conductive layer 4 is formed on the second principal surface 1B of the dielectric substrate 1. These first and second conductive layers 3 and 4 are preferably thin films comprising a conductive metallic material, the thin films being formed by sputtering, vacuum deposition, or the like. Also, the second conductive layer 4 preferably covers almost the entire area of the second principal surface 1B of the dielectric substrate 1, including the outer surface (the right and left side surfaces and the end surface) of the protrusion 2.

A slot 5 is an opening placed in the first principal surface 1A of the dielectric substrate 1 so as to extend through the first conductive layer 3. The slot 5 extends in the dielectric substrate 1 along the position facing the protrusion 2 (that is, in the direction parallel with the transmitting direction of a signal) so as to form a rectangular (groove) shape. Further, the slot 5 preferably has a width W2 of about 0.45 mm, which is substantially equal to the width W1 of the protrusion 2.

Next, the operation of the transmission line having the above-described configuration will be described.

When a high-frequency signal is input to the transmission line, an electric field E (FIGS. 1–3) is formed in the width direction of the protrusion 2 or the slot 5 and a magnetic field H (FIGS. 1–3) is formed in the longitudinal direction of the slot 5 and in the thickness direction of the dielectric substrate 1. The high-frequency signal travels along the slot 5 in the form of an electromagnetic wave of a mode compatible with the TEl0 mode, in which two side surfaces facing each other of the protrusion 2 are H surfaces, and the bottom surface of the protrusion 2 and the first principal surface 1A of the dielectric substrate 1 are E surfaces. At this time, the high-frequency signal is repeatedly totally-reflected at the bottom surface of the protrusion 2 and at the first principal surface 1A of the dielectric substrate 1 provided with the slot 5, and locally travels inside the dielectric substrate 1 and the vicinity thereof.

In this embodiment, since the protrusion 2 is provided on the second principal surface 1B of the dielectric substrate 1 and the slot 5 is provided in the first principal surface 1A such that the slot 5 faces the protrusion 2, a high-frequency signal can locally travel between the bottom surface of the protrusion 2 and the slot 5 and the vicinity thereof. Accordingly, the amount of radiation of the high-frequency signal from the slot 5 can be reduced compared to the known slot line, and thus transmission loss can be significantly reduced.

Also, since the protrusion 2 faces the slot 5 and the end surface of the protrusion 2 is covered with the second conductive layer 4, the high-frequency signal does not radiate from the second principal surface 1B of the dielectric substrate 1. Accordingly, the high-frequency signal radiates only from the first principal surface 1A of the dielectric substrate 1 even when the protrusion 2 and the slot 5 are displaced with respect to each other, and thus transmission loss due to radiation of the high-frequency signal can be reduced.

Furthermore, since the dielectric substrate 1 comprises a ceramic material, a resin material, or a composite material containing a ceramic material and a resin material, the heat resistance of the dielectric substrate 1 can be improved. Therefore, various surface-mounting components can be mounted by using batch reflow soldering so as to increase productivity.

Second Embodiment

Figure 4:
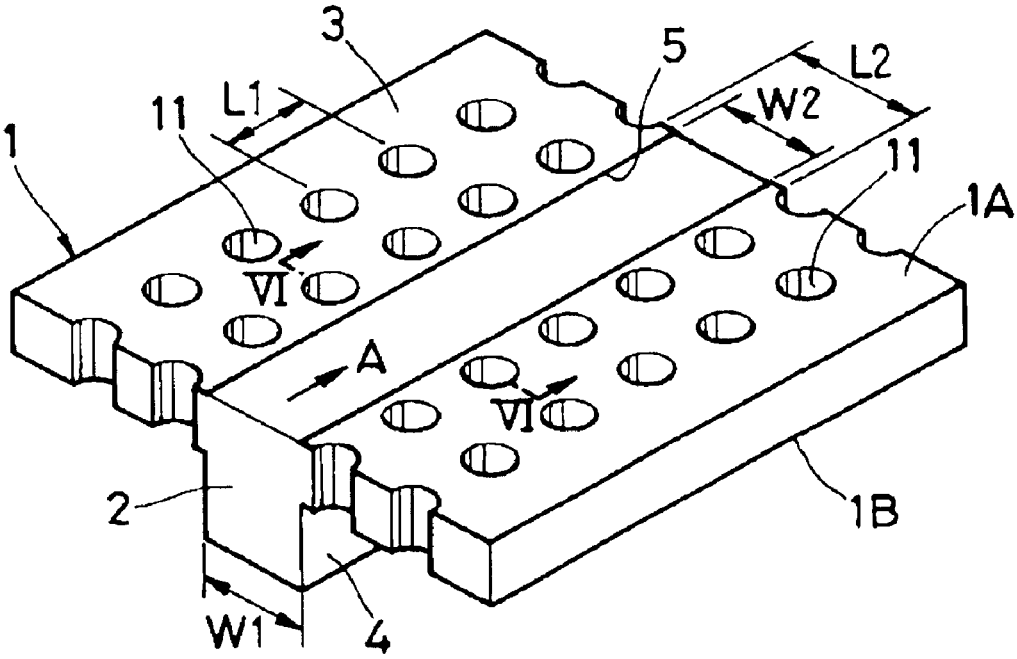
FIG. 4 is a perspective view showing a transmission line according to a second embodiment.
Figure 5:
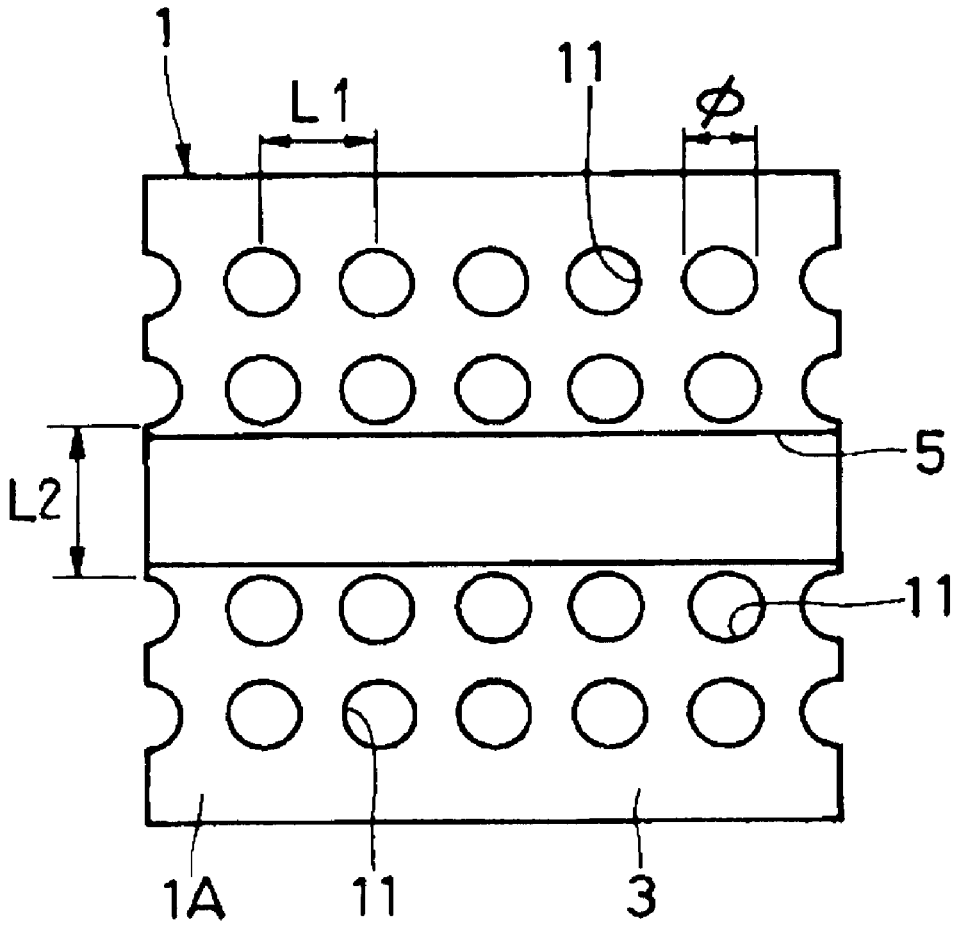
FIG. 5 is a plan view showing the transmission line according to the second embodiment.
Figure 6:
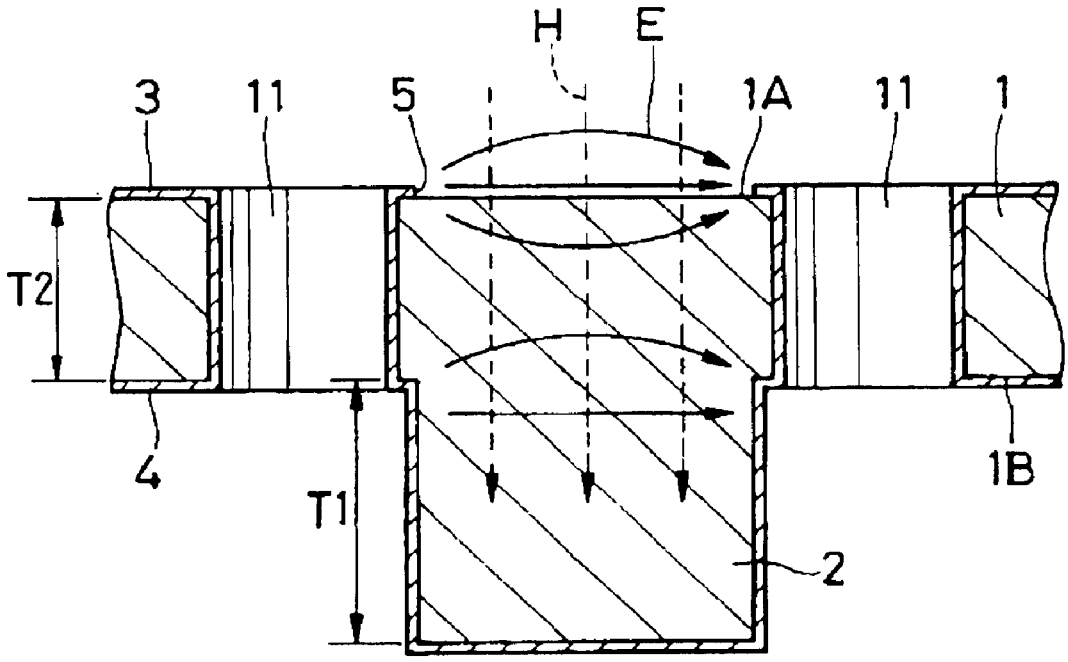
FIG. 6 is an enlarged sectional view taken along the line VI—VI of FIG. 4.

FIGS. 4 to 6 show a transmission line according to a second embodiment of the present invention. The transmission line according to this embodiment is characterized in that a plurality of through-holes, which extend through the dielectric substrate 1 so as to establish conduction between the two conductive layers, are formed at the left and right sides of the protrusion 2 (FIGS. 4, 6). In this embodiment, elements which are the same as those in the first embodiment are denoted by the same reference numerals, and the corresponding description will be omitted.

The through-holes 11 (FIGS. 4–6 ) are preferably placed at both sides of the protrusion 2 and are formed along the direction in which the protrusion 2 extends. Each of the through-holes 11 is preferably a substantially circular through-hole having an internal diameter ϕ (FIG. 5) of about 0.3 mm and is formed by laser processing or punching. The through-holes 11 are preferably aligned in two lines at each of the right and left sides, that is, in four lines in total, along the transmitting direction of a high-frequency signal (direction of arrow A FIG. 4)). The four lines are preferably parallel to each other. Also, the through-holes 11 in the line near the protrusion 2 and the through-holes 11 in the outer line are preferably parallel to each other in the direction of the arrow A. Further, each of the through-holes 11 extends through the dielectric substrate 1 and the inner wall thereof is preferably covered with a conductive metallic material so that the first conductive layer 3 and the second conductive layer 4 (FIG. 4, 6) are electrically connected.

The pitch L1 (FIG. 4, 5) of two adjacent through-holes 11 in the transmitting direction of a high-frequency signal is preferably set to below λg/2 with respect to the wavelength λg of the high-frequency signal at the working frequency in the dielectric substrate 1. Also, the pitch L2 (FIG. 4, 5) between the two lines of through-holes 11 at both sides of the protrusion 2 is preferably set to below λg/2 with respect to the wavelength λg of the high-frequency signal in the dielectric substrate 1.

Further, in this embodiment, the thickness T2 (FIG. 6) of the dielectric substrate 1 and the height T1 (FIG. 6) of the protrusion 2 are preferably set so that the potentials of the first and second conductive layers 3 and 4 placed at both ends in the height direction of the through-holes 11 are substantially equal to each other.

Figure 7:
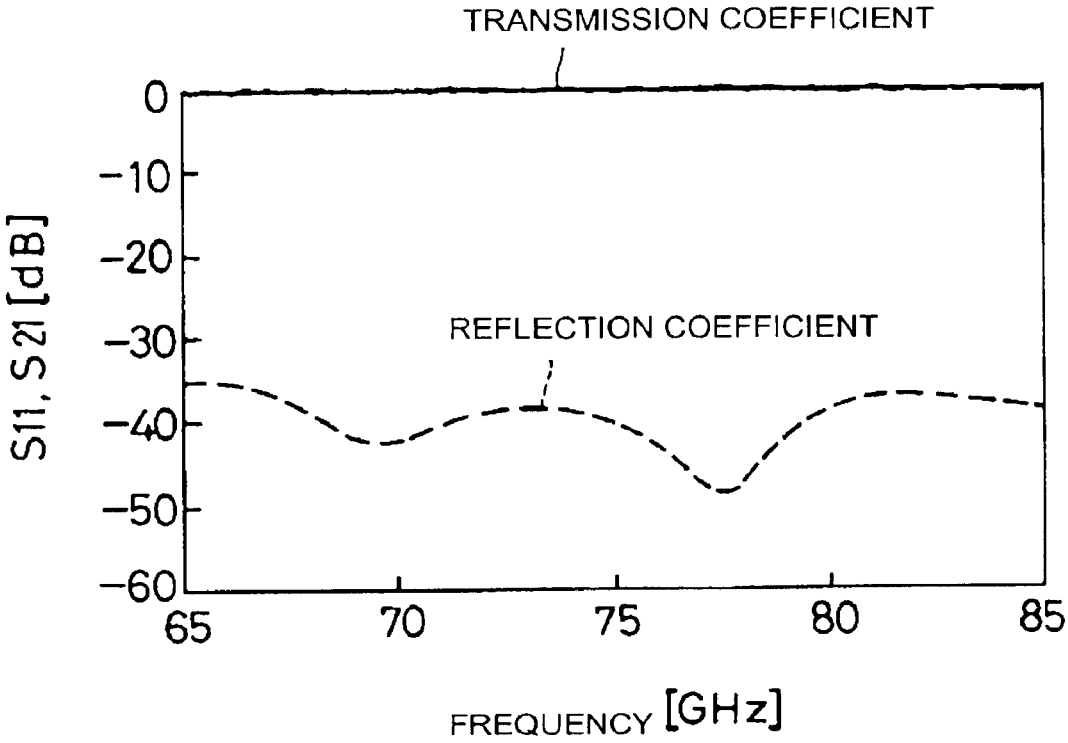
FIG. 7 is a characteristic diagram showing the relationship between the reflection coefficient and the transmission coefficient, and the frequency of a high-frequency signal according to the transmission line shown in FIG. 4.

In this transmission line, for example, when the pitch L1 of the through-holes 11 in the transmitting direction of the high-frequency signal is set to 0.6 mm, the pitch L2 between the two lines of through-holes 11 at both sides of the protrusion 2 is set to 0.65 mm, the thickness T2 of the dielectric substrate 1 is set to 0.3 mm, the height T1 of the protrusion 2 is set to 0.38 mm, the width W1 (FIG. 4) of the protrusion 2 is set to 0.45 mm, and the width W2 (FIG. 4) of the slot 5 is set to 0.45 mm so as to perform a three-dimensional electromagnetic field simulation, the transmission characteristic shown in FIG. 7 can be obtained.

Accordingly in FIG. 7, the reflection coefficient S11 can be lower than −30 dB with respect to a high-frequency signal of about 65 to 85 GHz, and the transmission coefficient S21 can be kept at almost 0 dB. Thus, the high-frequency signal can be transmitted with low loss.

In the second embodiment, the same advantages as in the first embodiment can be obtained. Also, in the second embodiment, since the plurality of through-holes 11 for establishing conduction between the two conductive layers 3 and 4 are formed at both sides of the protrusion 2, a high-frequency signal can be confined between the protrusion 2 and the slot 5. Thus, radiation of the high-frequency signal from the right and left sides of the protrusion 2 can be suppressed. Accordingly, transmission loss due to radiation of the high-frequency signal can be reduced.

Also as seen in FIGS. 4, 6, since the protrusion 2 extending along the transmitting direction of the high-frequency signal is provided on the second principal surface 1B of the dielectric substrate 1 and the second conductive layer 4 is provided so as to cover the second principal surface 1B of the dielectric substrate 1, including the outer surface of the protrusion 2, a current can be applied to the side surfaces of the protrusion 2 as well as to the through-holes 11. Further, since the protrusion 2 continuously extends in the transmitting direction of the high-frequency signal, a current can be applied in an oblique direction of the dielectric substrate 1 as well as in the thickness direction of the dielectric substrate 1. Accordingly, concentration of current in the through-holes 11 can be alleviated and thus transmission loss can be reduced compared to a case where the protrusion 2 is not provided.

In particular, in the second embodiment, the thickness T2 of the dielectric substrate 1 and the height T1 of the protrusion 2 are preferably set so that the potentials of the conductive layers 3 and 4 at both ends in the height direction of the through-holes 11 are substantially equal to each other. Accordingly, a current does not flow in the height direction of the through-holes 11, a current does not concentrate at the through-holes 11, and thus the transmission loss can be further reduced.

Figure 8:
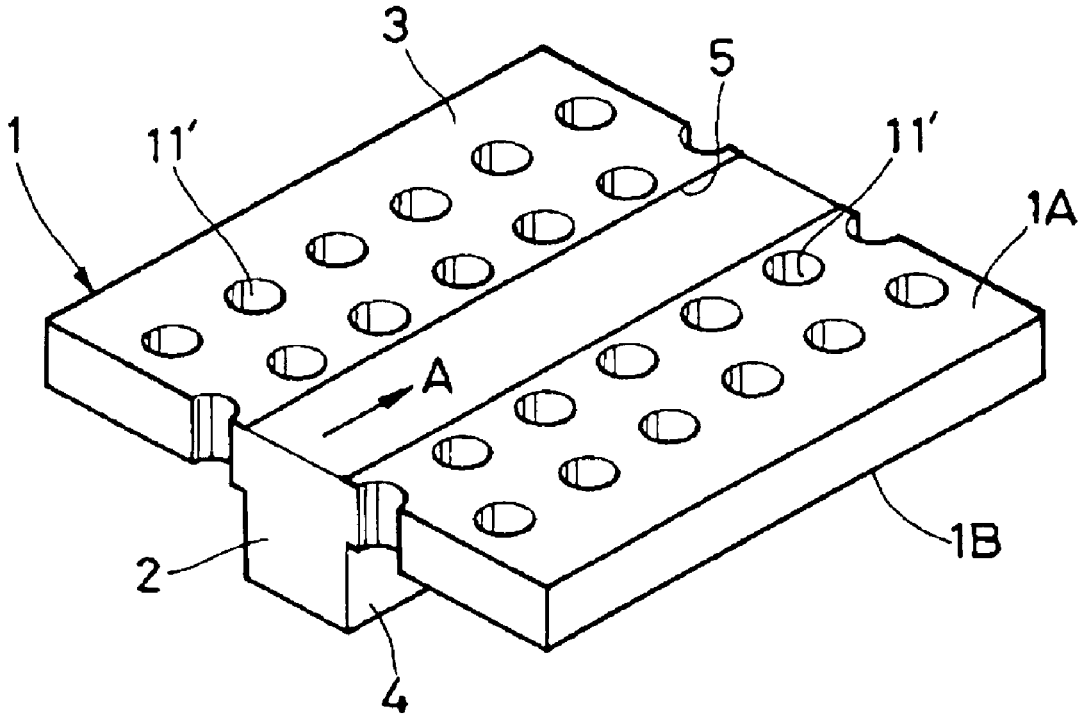
FIG. 8 is a perspective view showing a transmission line according to a first modification.

In the second embodiment, the through-holes 11 in the line near the protrusion 2 and the through-holes 11 in the outer line are preferably placed so as to be parallel with the transmitting direction of the high-frequency signal. However, as in a first modification shown in FIG. 8, through-holes 11' in the line near the protrusion 2 and through-holes 11' in the outer line may be arranged in a staggered configuration such that the two lines are staggered with respect to each other in the direction of arrow A.

Third Embodiment

Figure 9:
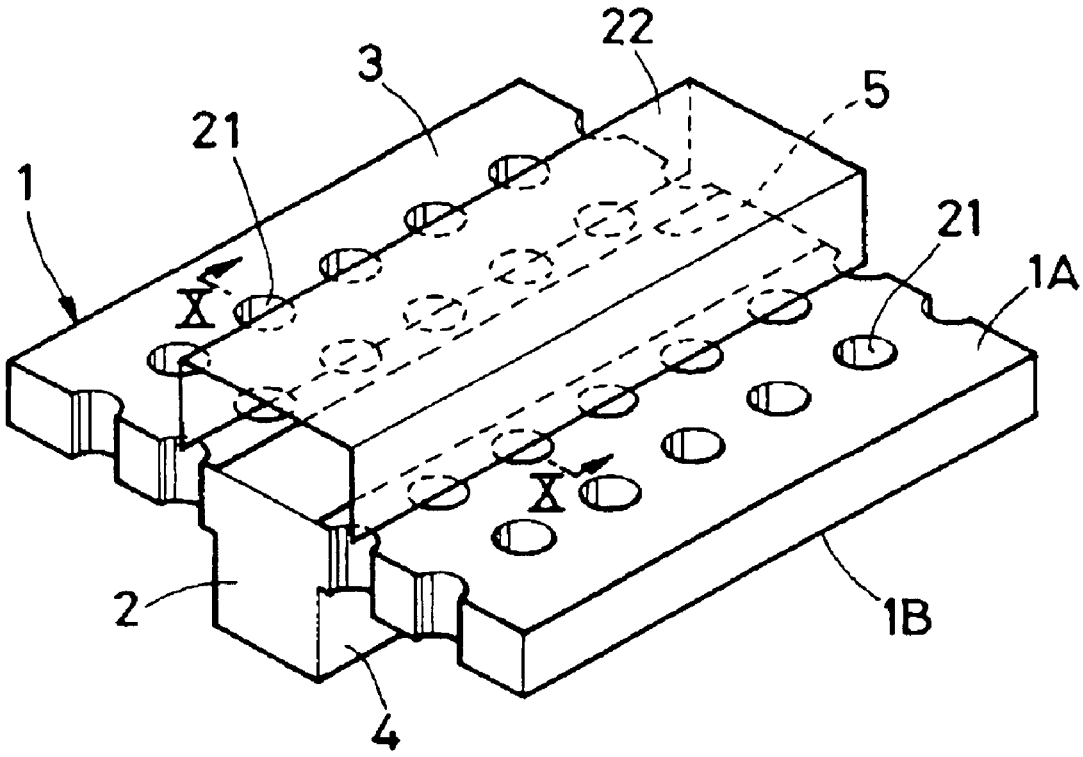
FIG. 9 is a perspective view showing a transmission line according to a third embodiment.
Figure 10:
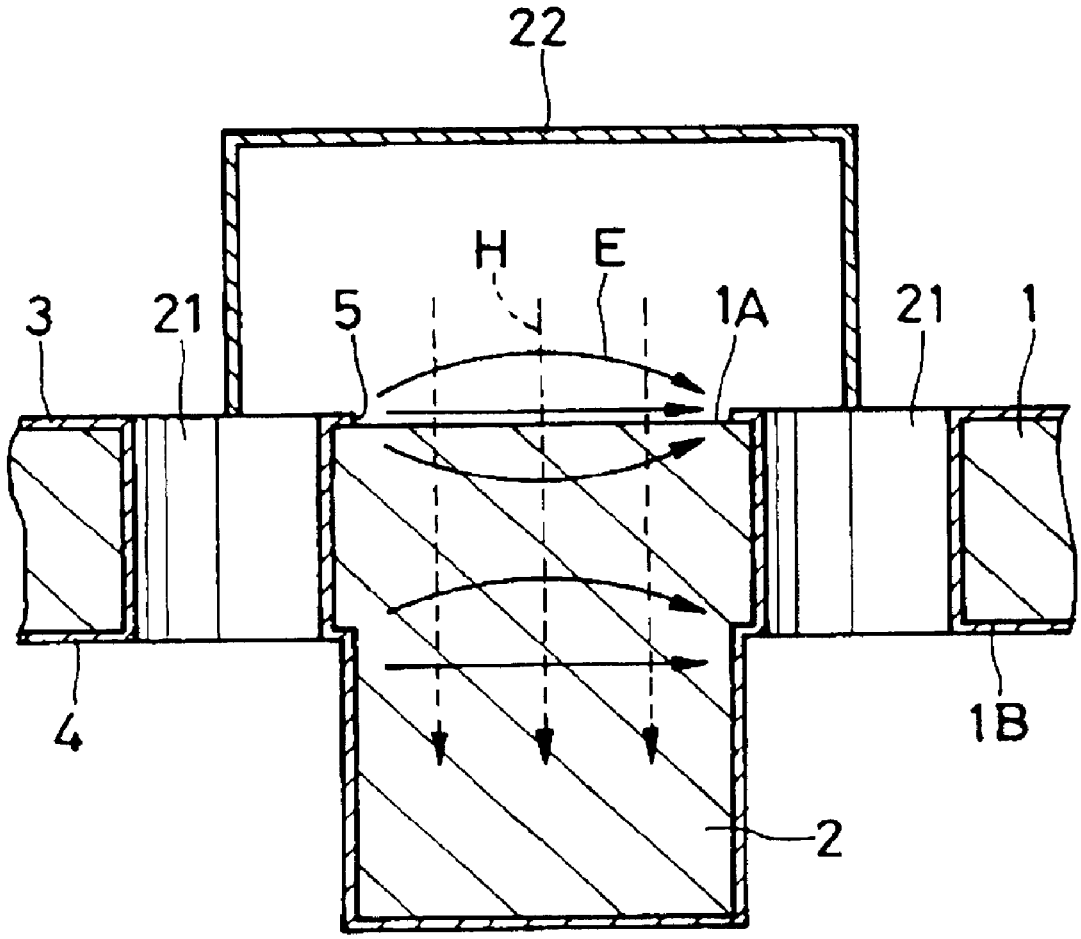
FIG. 10 is an enlarged sectional view taken along the line X—X of FIG. 9.

FIGS. 9 and 10 show a transmission line according to a third embodiment of the present invention. The transmission line of this embodiment is characterized in that a shield member for covering the slot is provided on the first principal surface of the dielectric substrate 1. In this embodiment, elements which are the same as those in the first embodiment are denoted by the same reference numerals, and the corresponding description will be omitted.

As in the second embodiment, through-holes 21 (FIG. 9, 10) are provided at both sides of the protrusion 2 and formed in the direction in which the protrusion 2 extends. Each of the through-holes 21 is a substantially circular through-hole having an inner diameter of about 0.3 mm. The through-holes 21 are aligned in two lines at each of the right and left sides, that is, in four lines in total, such that the four lines are parallel with each other. Further, the through-holes 21 extend through the dielectric substrate 1 and the inner wall thereof is covered with a conductive metallic material so that the conductive layers 3 and 4 are electrically connected.

The shield member 22 (FIGS. 9, 10) is preferably attached to the first principal surface 1A of the dielectric substrate 1. The shield member 22 is formed by, for example, bending a conductive metallic plate in a U-shape. Also, the shield member extends in the longitudinal direction of the slot 5 and both ends of the shield member 22 are connected to the right and left sides of the first conductive layer 3 respectively, such that the shield member 22 covers the slot S and a space is formed between the slot 5 and the shield member 22.

In the third embodiment, the same advantages as in the first embodiment can be obtained. Also, in the third embodiment, since the slot 5 is covered by the shield member 22, a high-frequency signal radiated through the slot 5 can be confined in the vicinity of the slot 5 by the shield member 22 so that the high-frequency signal can be efficiently transmitted along the slot 5. Accordingly, transmission loss of a high-frequency signal can be reduced and unnecessary radiation of a high-frequency signal can be prevented.

Figure 11:
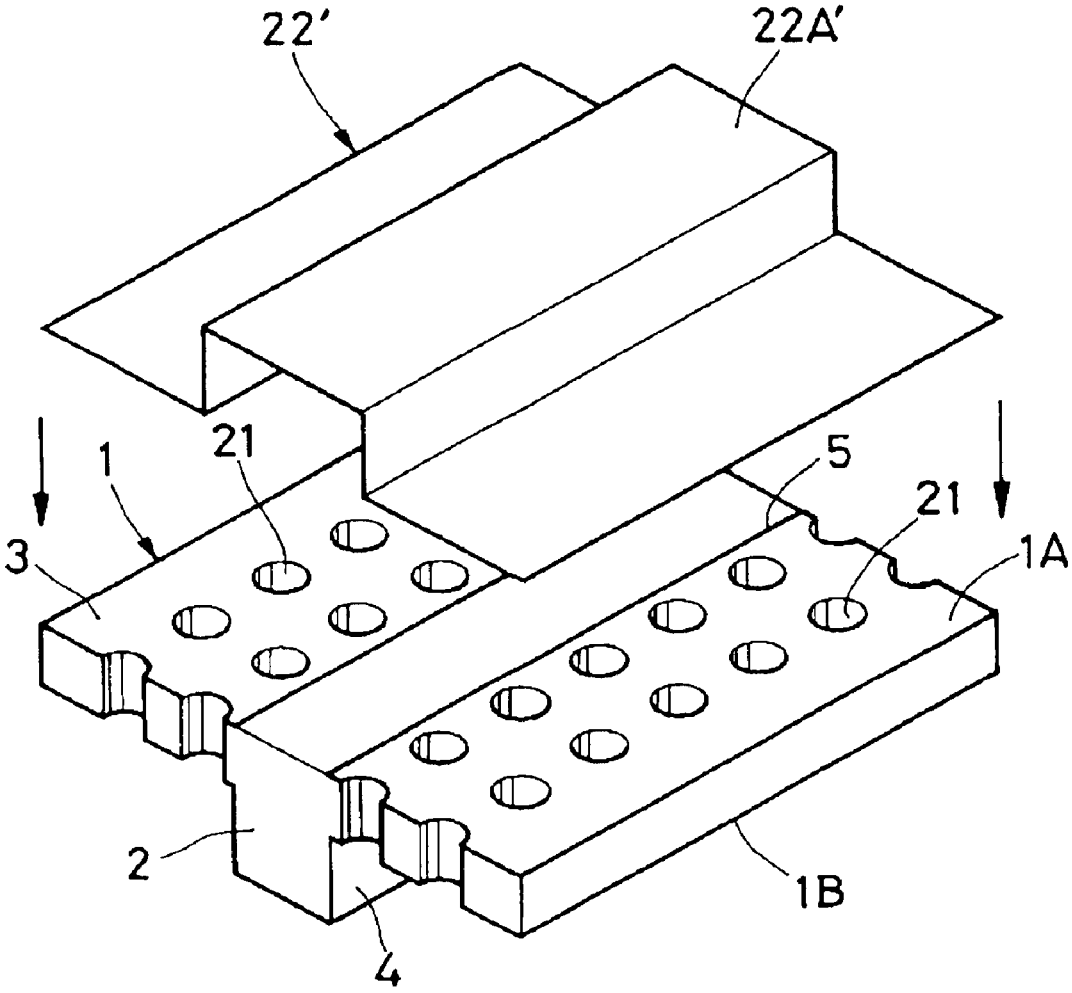
FIG. 11 is a perspective view showing a transmission line according to a second modification.

In the third embodiment, the shield member 22 covers only the slot 5 and the vicinity thereof. However, as in a second modification shown in FIG. 11, the whole area of the first principal surface 1A of the dielectric substrate 1 may be covered with a substantially flat shield member 22'. In this case, a protruded portion 22A' in a U shape is formed at the position facing the slot 5 so that the protruded portion 22A' covers the slot 5.

Fourth Embodiment

Figure 12:
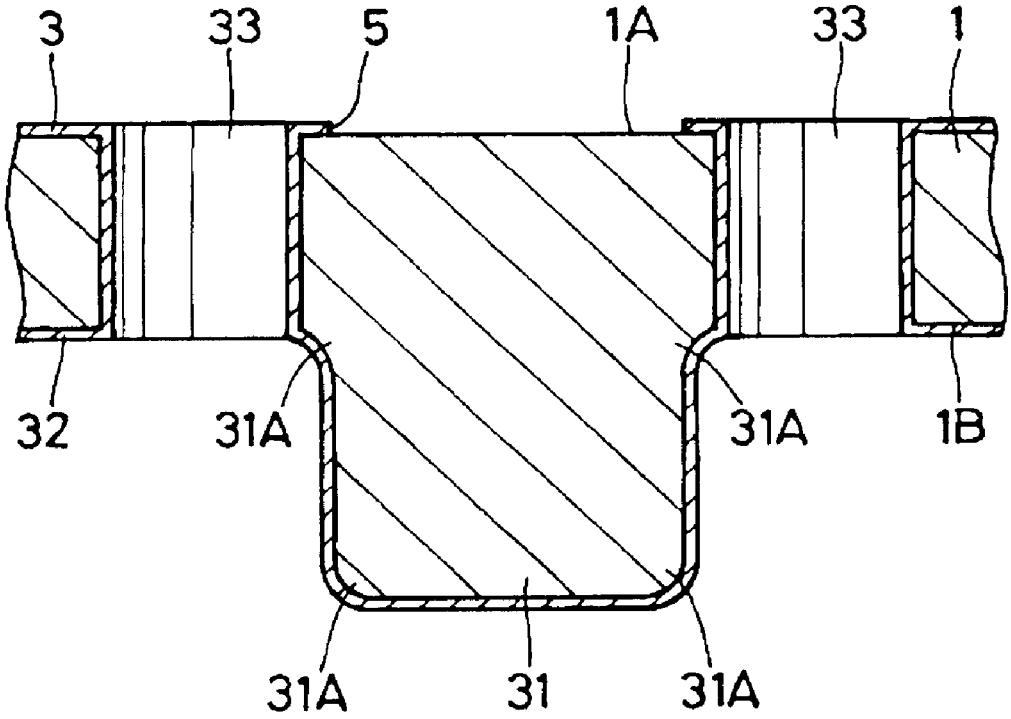
FIG. 12 is an enlarged sectional view showing a transmission line according to a fourth embodiment.

FIG. 12 shows a transmission line according to a fourth embodiment of the present invention. The transmission line according to this embodiment is characterized in that curved arc portions 31A are formed at corners of a protrusion 31. In this embodiment, elements which are the same as those in the first embodiment are denoted by the same reference numerals, and the corresponding description will be omitted.

The protrusion 31 is provided on the second principal surface 1B of the dielectric substrate 1. As in the first embodiment, the cross-section of the protrusion 31 and the dielectric substrate 1 forms a protruding shape, and the protrusion 31 extends in the transmitting direction of a high-frequency signal. Also, the arc portions 31A are formed at the corners and the foot of the protrusion 31. Accordingly, the outer surface of the protrusion 31 smoothly extends, including the borders of the second principal surface 1B of the dielectric substrate 1 and the protrusion 31.

A second conductive layer 32 is formed on the second principal surface 1B of the dielectric substrate 1 and covers the whole area of the second principal surface 1B including the outer surface (right and left surfaces and bottom surface) of the protrusion 31 so that the second principal surface 1B extends smoothly at the arc portions 31A.

Through-holes 33 are preferably provided at the right and left sides of the protrusion 31 and are formed in the direction in which the protrusion 31 extends. The through-holes 33 extend through the dielectric substrate 1 and the inner wall thereof is covered with a conductive metallic material so that the two conductive layers 3 and 32 are electrically connected.

In the fourth embodiment, the same advantages as in the first embodiment can be obtained. Also, in the fourth embodiment, since the arc portions 31A are provided at the corners of the protrusion 31 and the arc portions 31A are covered by the second conductive layer 32, a gap or crack is not generated in the second conductive layer 32. Therefore, a current can be applied to the second conductive layer 32 which covers the entire surface of the protrusion 31 including the arc portions 31A, and thus a concentration of a current can be alleviated and transmission loss can be reduced.

Fifth Embodiment

Figure 13:
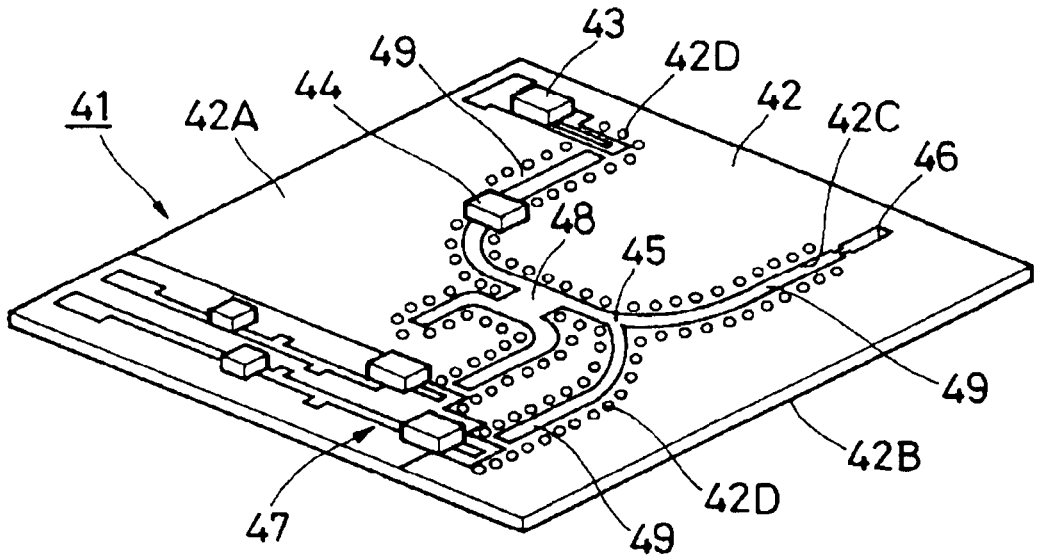
FIG. 13 is a plan view showing a radar device according to a fifth embodiment.
Figure 14:
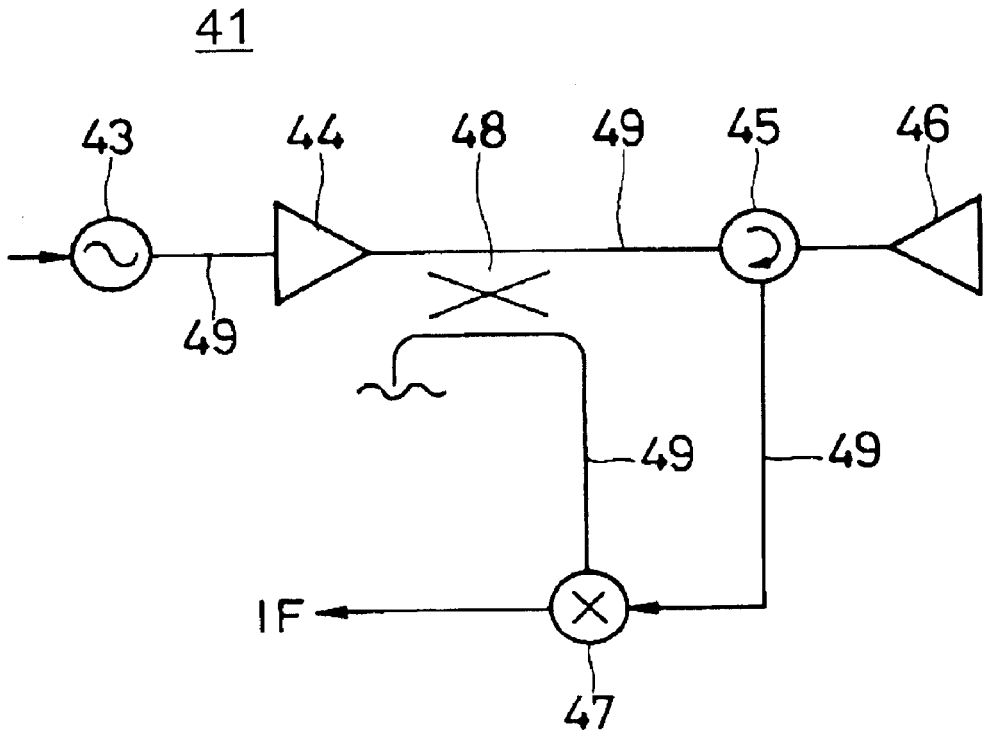
FIG. 14 is a block diagram showing the radar device according to the present invention.

FIGS. 13 and 14 show a radar device according to a fifth embodiment. The radar device is formed by using the transmission line according to the above-described embodiments.

The radar device 41 (FIG. 13) is a transmitter-receiver according to the fifth embodiment. The radar device 41 is formed by using a dielectric substrate 42 (FIG. 13) including a first conductive layer 42A (FIG. 13) on the first principal surface and a second conductive layer 42B (FIG. 13) on the second principal surface. The radar device 41 includes a voltage-controlled oscillator 43 provided on the first principal surface of the dielectric substrate 42, an amplifier 44, a circulator 45, an opening 46 forming a slot (See FIG. 13) which is connected to the voltage-controlled oscillator 43 through the amplifier 44 and the circulator 45, and a mixer 47 which is connected to the circulator 45 so as to down-convert a signal received from the opening 46 to an intermediate-frequency (IF) signal. Further, a directional coupler 48 is provided between the amplifier 44 and the circulator 45. A signal which is power-distributed by the directional coupler 48 is input as a local oscillation signal to the mixer 47.

The radar device 41 includes the dielectric substrate 42. The voltage-controlled oscillator 43, the amplifier 44, the circulator 45, and the mixer 47 are mutually connected by a transmission line (waveguide) 49 including, as in the second embodiment, a protrusion (not shown) provided on the second principal surface of the dielectric substrate 42, a slot 42C (FIG. 13) provided on the first principal surface of the dielectric substrate 42 along the protrusion, and a plurality of through-holes 42D (FIG. 13) provided along the protrusion.

The radar device according to this embodiment has the above-described configuration. An oscillation signal output from the voltage-controlled oscillator 43 is amplified by the amplifier 44, passes through the directional coupler 48 and the circulator 45, and is transmitted as a transmission signal from the opening 46. On the other hand, a reception signal received by the opening 46 is input to the mixer 47 through the circulator 45, is down-converted by using a local oscillation signal from the directional coupler 48, and is output as an intermediate-frequency (IF) signal.

According to the fifth embodiment, the waveguide 49 including the protrusion, the slot 42C, and the through-holes 42D is formed in the dielectric substrate 42. Also, the voltage-controlled oscillator 43, the amplifier 44, the circulator 45, and the mixer 47 are connected by using the waveguide 49. Accordingly, the amplifier 44 can be easily connected to the waveguide 49 by using only the first principal surface of the dielectric substrate 42, as in the known slot line. Further, the waveguide 49 can be connected to the voltage-controlled oscillator 43 with low loss, and thus the power efficiency of the entire radar device can be increased and the power consumption can be reduced.

In the fifth embodiment, the transmission line according to the present invention is applied to the radar device. However, the transmission line can be applied to a communication device serving as a transmitter-receiver. Also, in the fifth embodiment, a transmitter-receiver is formed by using the transmission line according to the second embodiment. However, the transmission line according to any of the first, third, and fourth embodiments can be used.

In the third to fifth embodiments, the through-holes 21, 33, or 42D are provided in the dielectric substrate 1 or 42. However, the through-holes may not be provided as in the first embodiment.

In the second to fourth embodiments, the plurality of through-holes 11, 21, or 33 are aligned in four lines, that is, in two lines at both sides of the protrusion 2 or 31 in the dielectric substrate 1. However, a plurality of through holes may be aligned in two lines, that is, each line at both sides of the protrusion as in the fifth embodiment. Alternatively, a plurality of through-holes may be aligned in six lines or more. Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A transmission line comprising:

a dielectric substrate including first and second principal surfaces and a protrusion which extends outwardly from the second principal surface and which longitudinally extends in a transmitting direction of a high-frequency signal;

a first conductive layer provided on the first principal surface of the dielectric substrate;

a second conductive layer provided on the second principal surface of the dielectric substrate; and a slot provided in the first conductive layer so as to extend along the longitudinal direction of the protrusion.

2. The transmission line according to claim 1, wherein the slot in the first conductive layer of the dielectric substrate is placed at a position facing the protrusion.

3. The transmission line according to claim 1, wherein a shape of the slot is substantially the same as a portion of the protrusion that contacts the second principal surface of the dielectric substrate.

4. The transmission line according to claim 1, wherein the second conductive layer is disposed on outer surfaces of the protrusion.

5. The transmission line according to claim 1, wherein a width of the slot is substantially equal to a width of the protrusion.

6. The transmission line according to claim 1, further comprising a plurality of through-holes extending from the first principal surface to the second principal surface of the dielectric substrate so as to establish conduction between the first and second conductive layers.

7. The transmission line according to claim 6, wherein the plurality of through holes are arranged in a first group on one side of the protrusion and a second group on a second side of the protrusion.

8. The transmission line according to claim 7, wherein the first group and the second group of through holes are disposed along the longitudinal direction of the protrusion.

9. The transmission line according to claim 8, wherein the first group and the second group of through holes are each arranged in two respective lines.

10. The transmission line according to claim 9, wherein the two lines of through holes of the first group are parallel to each other, and the two lines of through holes of the second group are parallel to each other.

11. The transmission line according to claim 10, wherein a pitch between the two lines of through holes of at least one of the first and second groups of through holes is set to be below $\lambda g/2$ with respect to a wavelength $\lambda g$ of the high-frequency signal.

12. The transmission line according to claim 6, wherein a pitch between two adjacent through holes is set to be below $\lambda g/2$ with respect to a wavelength $\lambda g$ of the high-frequency signal.

13. The transmission line according to claim 6, wherein a thickness of the dielectric substrate and a height of the protrusion are set so that a potential of the first conductive layer is substantially equal to a potential of the second conductive layer.

14. The transmission line according to claim 1, further comprising a shield member covering the slot.

15. The transmission line according to claim 14, wherein the shield member is attached to the first principal surface of the dielectric substrate.

16. The transmission line according to claim 14, wherein the shield member is connected to the first conductive layer.

17. The transmission line according to claim 14, wherein the shield member also includes portions which cover the first principal surface of the dielectric substrate.

18. The transmission line according to claim 1, wherein the protrusion includes arc portions disposed at corners of the protrusion, and arc portions disposed at locations where the protrusion and the dielectric substrate meet.

19. The transmission line according to claim 1, wherein the dielectric substrate comprises one of a ceramic material, a resin material, and a composite material containing a ceramic material and a resin material.

20. A transmitter-receiver comprising the transmission line according to claim 1.

* * * * *